US007017540B2

(12) United States Patent
Kinugawa et al.

(10) Patent No.: US 7,017,540 B2
(45) Date of Patent: Mar. 28, 2006

(54) VALVE TIMING ADJUSTING DEVICE AND ASSEMBLY APPARATUS OF THE SAME

(75) Inventors: Hiroyuki Kinugawa, Tokyo (JP); Koji Yudate, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/949,397

(22) Filed: Sep. 27, 2004

(65) Prior Publication Data

US 2005/0115527 A1 Jun. 2, 2005

(30) Foreign Application Priority Data

Nov. 27, 2003 (JP) ..... 2003-397541

(51) Int. Cl.
*F01L 1/34* (2006.01)

(52) U.S. Cl. ..... 123/90.17; 123/90.15; 123/90.31; 464/160

(58) Field of Classification Search ..... 123/90.15, 123/90.16, 90.17, 90.18, 90.27, 90.31; 464/1, 464/2, 160
See application file for complete search history.

(56) References Cited

U.S. PATENT DOCUMENTS 6,311,657 B1 * 11/2001 Sugawara et al. ..... 123/90.17
6,460,496 B1 * 10/2002 Fukuhara et al. ..... 123/90.17

FOREIGN PATENT DOCUMENTS

JP 10-339116 A 12/1998
JP 11-101107 A 4/1999
WO WO 01/34947 A1 5/2001

* cited by examiner

*Primary Examiner*—Thomas Denion
*Assistant Examiner*—Ching Chang
(74) *Attorney, Agent, or Firm*—Sughrue Mion, PLLC

(57) ABSTRACT

A valve timing adjusting device includes a first rotor that rotates synchronously with a crankshaft of an engine, a second rotor that is relatively rotatable by a predetermined angle within the first rotor and is secured on the end face of an intake or exhaust camshaft, and a lock mechanism that restricts a relative rotation between the first rotor and the second rotor. The receiving hole of the lock mechanism is a stepped structure having a small part provided at the outermost located radially to the device.

6 Claims, 6 Drawing Sheets

VALVE TIMING ADJUSTING DEVICE AND ASSEMBLY APPARATUS OF THE SAME

BACKGROUND OF THE INVENTION

1. Field of the Invention

The present invention relates to a valve timing adjusting device for controlling opening and closing timing of an intake valve or an exhaust valve of an internal combustion engine (hereinafter referred to as an "engine"), and to an assembly apparatus of the device.

2. Description of the Related Art

A conventional valve timing adjusting device is generally composed of a first rotor that is connected to a crankshaft of an engine by a rotational-driving force-transmitting member such as a chain, and that rotates synchronously with the crankshaft, a second rotor that is provided relatively rotatably by a predetermined angle within the first rotor, and that is integrally secured on the end face of an intake camshaft or an exhaust camshaft of the engine, and a plurality of partitioned oil pressure chambers located between the second rotor and the above first rotor. It is arranged such that an oil pump, which assumes charge of supplying oil to a sliding portion of the engine, supplies to and exhausts from these oil pressure chambers, and this hydraulic pressure controls a relative position of the second rotor with respect to the first rotor.

Among such valve timing adjusting devices, there are some valve timing adjusting devices equipped with a lock mechanism that restricts a relative rotation between the first rotor and the second rotor to an initial position in order to prevent the first rotor and the second rotor from inadvertently contacting with each other, and from thereby making abnormal noises at the time of an engine start where the device stands yet low oil pressure. This lock mechanism is generally composed of a lock hole formed in one rotor, a cylindrical receiving hole formed in the other rotor, a lock pin slidably provided within the receiving hole, an urging member for continuously urging the lock pin in one direction of its sliding directions, and a lock releasing oil passage that supplies hydraulic pressure for moving the lock pin in the other direction of its sliding directions against an urging force of the urging member. Such a lock mechanism is for restricting (locking) a relative rotation of both the rotors by urging the lock pin in the lock hole on the strength of an urging force of the urging member, as well as for releasing the lock of the relative rotation of both the rotors by releasing the engagement between the lock pin and the lock hole against an urging force of the urging member relaying upon hydraulic pressure applied from the lock-releasing oil passage.

In cases where the lock pin slides and the urging member urges radially to the valve timing adjusting device (hereinafter referred to simply as "radially to the device"), it is necessary by all costs to build in an locking member for preventing the urging member from coming off from the receiving hole at the outermost of the receiving hole formed radially to the device.

The structure of the locking member of a conventional valve timing adjusting device and a method of preventing the member from coming off are described in a variety of prior documents. For example, JP 10-339116 A discloses a method of preventing fallout of a locking member by closing the outermost part of the receiving hole formed radially to the device by an inner peripheral surface of a timing pulley constituting a part of the first rotor. However, such a method of preventing fallout of the locking member cannot not only be disadvantageously applied to a valve timing adjusting device, which does not include a timing pulley, but also be disadvantageously avoided dimensional expansion developing radially to the device in the outer part of the receiving hole out of sheer necessity of closing the receiving hole by the inner peripheral surface of the timing pulley.

Meanwhile, JP 11-101107 A discloses an locking member (plate-shaped retainer), which is engaged in a groove that extends axially to the device and opens to the end face located axially to the device. However, because sliding direction of the lock pin and inserting direction of the locking member cross each other at right angles, it must involve a process of temporarily compressing inwardly the urging member radially to the device by means of a jig when inserting the locking member therein, and of pulling out the jig therefrom after an insertion of the locking member is completed, with disadvantageously requires much time for assembly.

Moreover, WO01/34947A discloses a method of restricting the movement of an locking member, which is slidably provided in a receiving hole in a sliding direction of the lock pin by a restricting member inserted axially to the device. However, the addition of the restricting member is required as a new separate component for preventing fallout of the locking member, which disadvantageously incurs an increase in manufacturing cost.

SUMMARY OF THE INVENTION

The present invention has been made to overcome the above drawbacks of the conventional valve timing adjusting devices. An object of the present invention is to provide a valve timing adjusting device having a lock mechanism that is easily assembled and has high reliability, and is to provide an assembly apparatus of the device.

The valve timing adjusting device according to the present invention includes a first rotor that rotates synchronously with a crankshaft; a second rotor that is relatively rotatble by a predetermined angle within the first rotor, and is integrally secured on the end face of the intake camshaft or the exhaust camshaft of the internal combustion engine; and a lock mechanism having a receiving hole that is formed passing through the first rotor radially to the device; a lock pin that is slidably provided within the receiving hole; an engaging hole that is formed within the second rotor, and engages with the lock pin; an urging member for urging the lock pin toward the second rotor; and an locking member for locking the urging member within the receiving hole; wherein the receiving hole of the lock mechanism is a stepped structure having a small part at the outermost located radially to the device.

Therefore, according to the present invention, it becomes possible to insert the locking member, the urging member, and the lock pin in this order in the receiving hole from the innermost part of the hole formed radilly to the device, thereby facilitating easy assembly of the components. Moreover, according to the present invention, it prevents the locking member from outwardly coming off radially to the device by the small part of the receiving hole, thereby greatly enhancing reliability of the lock mechanism.

Further, the assembly apparatus of the valve timing adjusting device according to the present invention includes a first rotor that rotates synchronously with a crankshaft of an internal combustion engine; a second rotor that is relatively rotatable by a predetermined angle within the first rotor, and is integrally secured on the end face of the intake camshaft or the exhaust camshaft of the internal combustion engine; and a lock mechanism having a receiving hole that is formed passing through the first rotor radially to the device, and has a stepped structure having a small part at the outermost located radially to the device; a lock pin that is slidably provided within the receiving hole; an engaging hole that is formed within the second rotor and engages with the lock pin; an urging member for urging the lock pin toward the second rotor; an locking member for locking the urging member within the receiving hole; and a back-pressure exhausting hole that is formed within the locking member, and exhausts back pressure of the lock pin into the open air; wherein the assembly apparatus includes a negative-pressure generating means provided at the outside of the receiving hole formed radially to the device for giving negative pressure for holding the lock pin at the backward end of the pin through the back-pressure exhausting hole of the locking member.

Therefore, according to the present invention, the lock pin can be completely contained within the receiving hole by the negative-pressure generating means, thereby avoiding the lock pin from inwardly projecting radially to the device, which facilitate assembly of the second rotor in the first rotor.

DETAILED DESCRIPTION OF THE PREFERRED EMBODIMENTS

Preferred embodiments of the present invention will now be described as below with reference to the attached drawings.

First Embodiment

Figure 1:
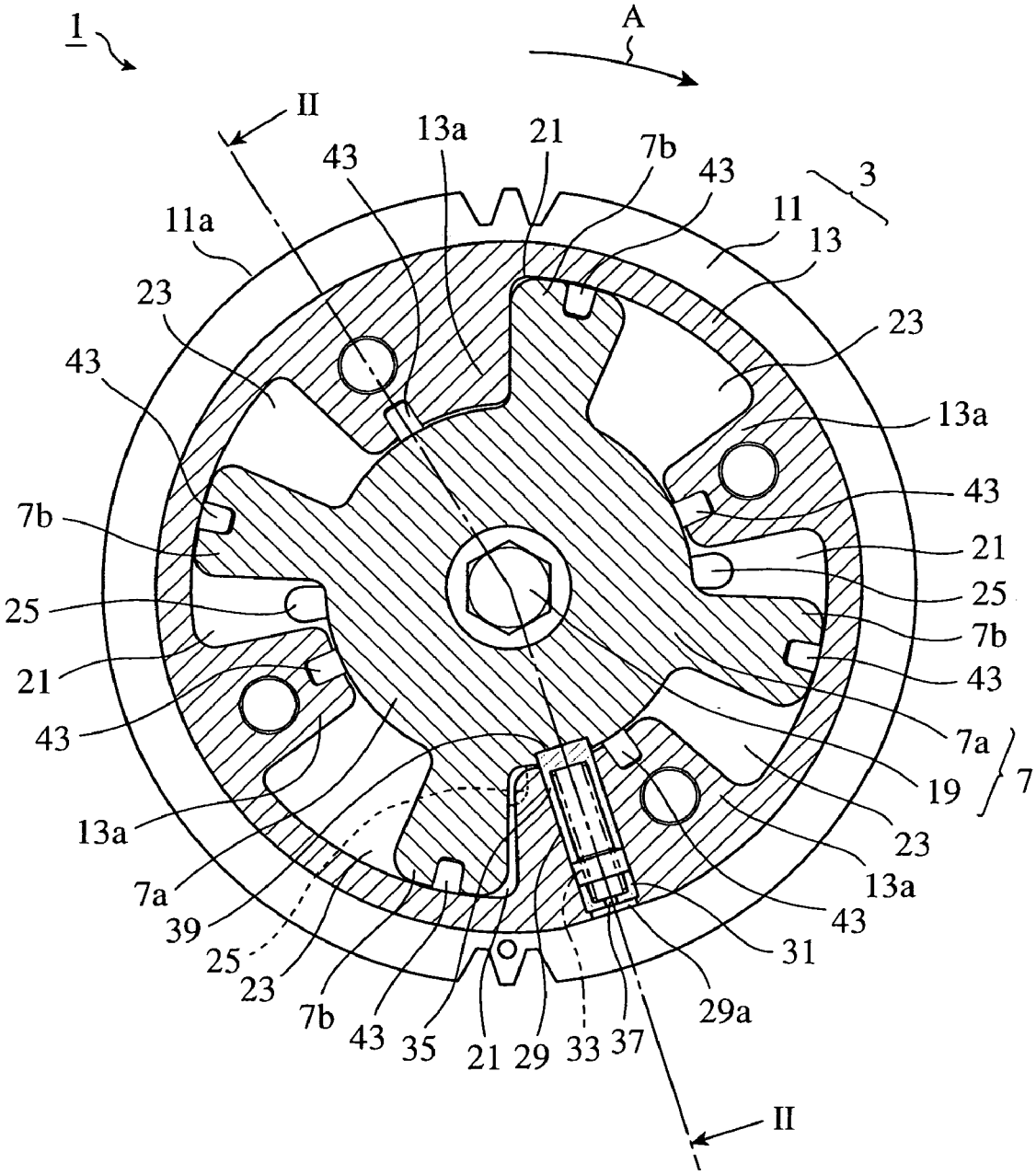
FIG. 1 is a radial sectional view showing an internal structure of a valve timing adjusting device according to a first embodiment of the present invention.
Figure 2:
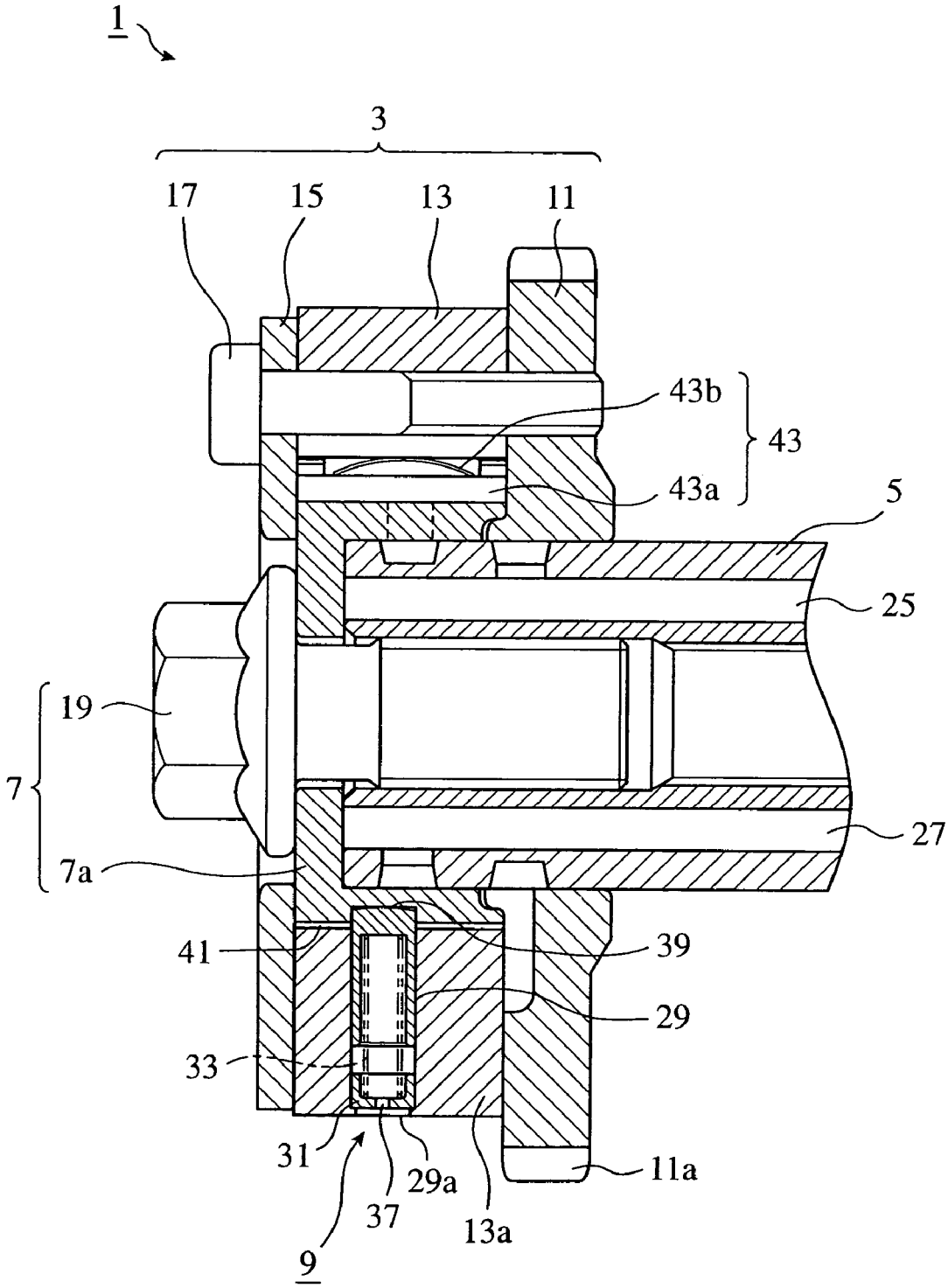
FIG. 2 is an axial sectional view taken along the line II—II of FIG. 1.
Figure 3:
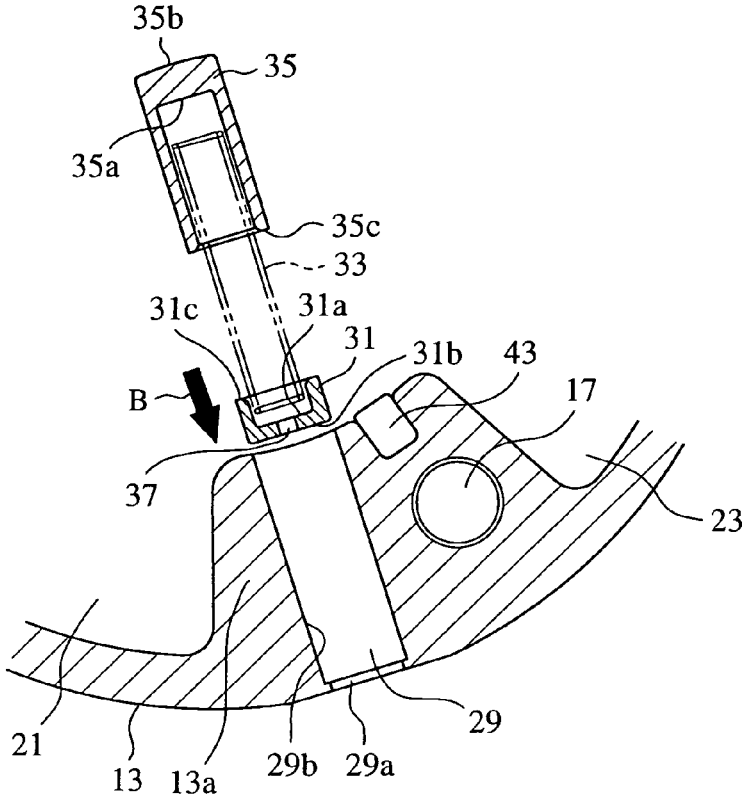
FIG. 3 is an enlarged radial sectional view showing the state where an locking member, an urging member, and a lock pin are inserted in this order in a receiving hole in one process of assembly of the lock mechanism of the valve timing adjusting device shown in FIG. 1.
Figure 4:
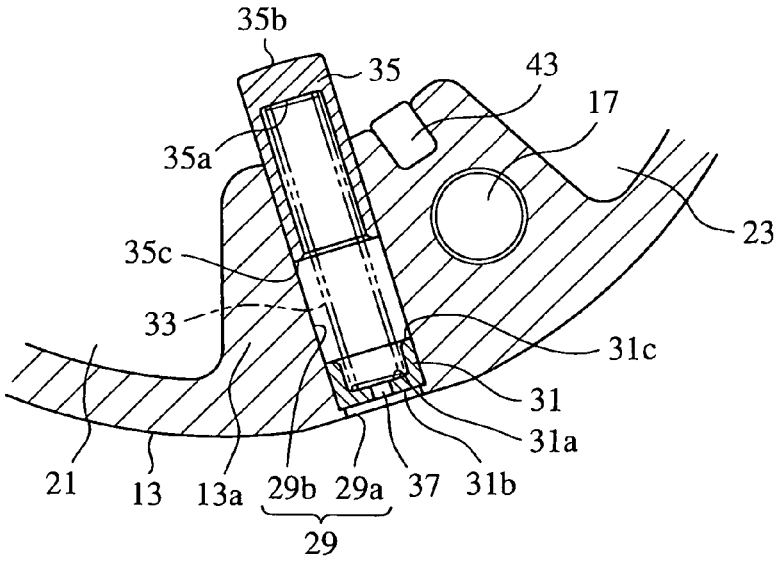
FIG. 4 is an enlarged radial sectional view showing the state where the locking member, the urging member, and the lock pin are inserted in the receiving hole in the subsequent process shown in FIG. 3.
Figure 5:
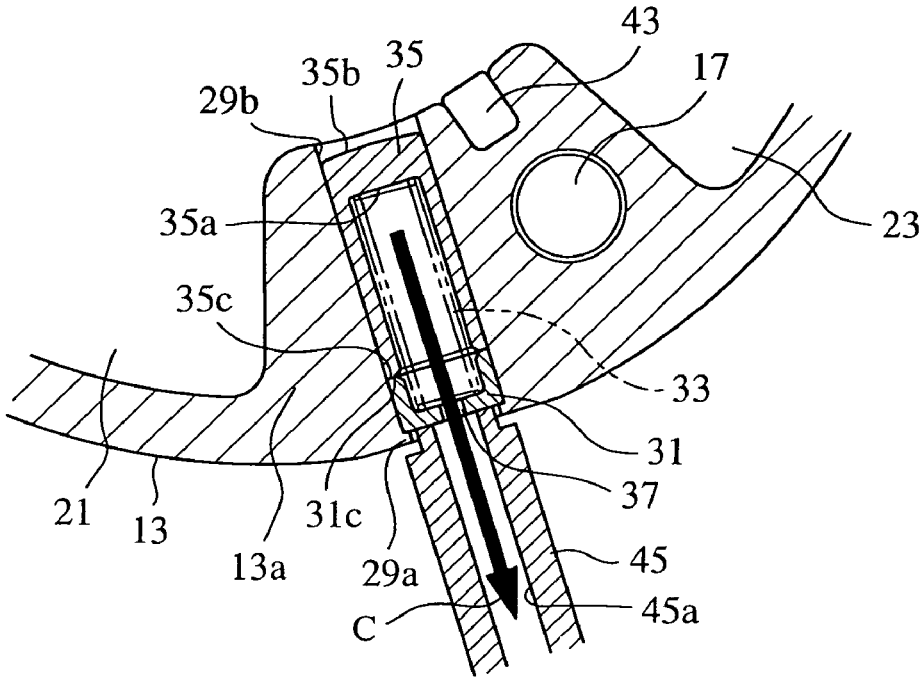
FIG. 5 is an enlarged radial sectional view showing the state where the lock pin is held at the backward end by the negative-pressure generating means of an assembly apparatus in the subsequent process shown in FIG. 4.
Figure 6:
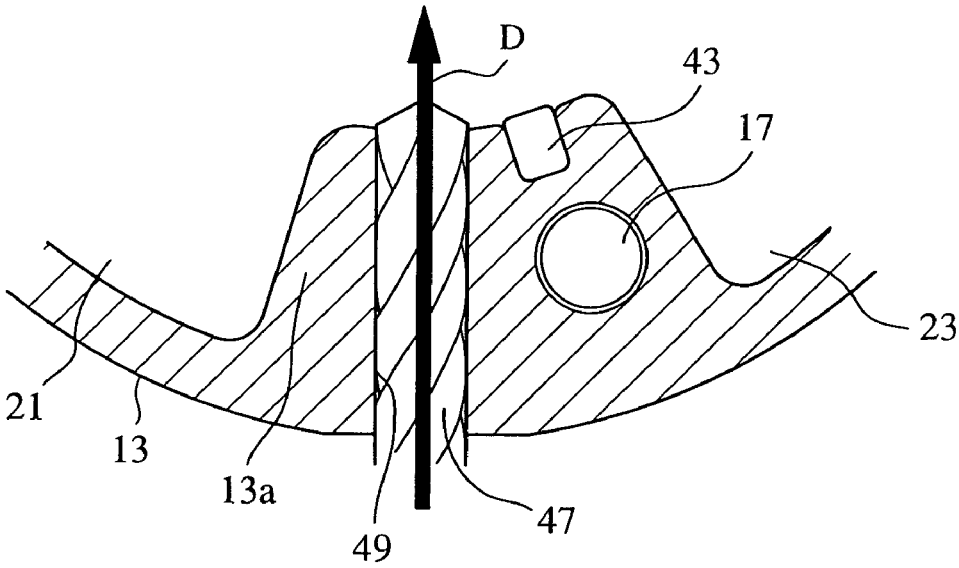
FIG. 6 is an enlarged radial sectional view showing the state where a through hole is formed in a forming process of the receiving hole of the valve timing adjusting device shown in FIG. 1.
Figure 7:
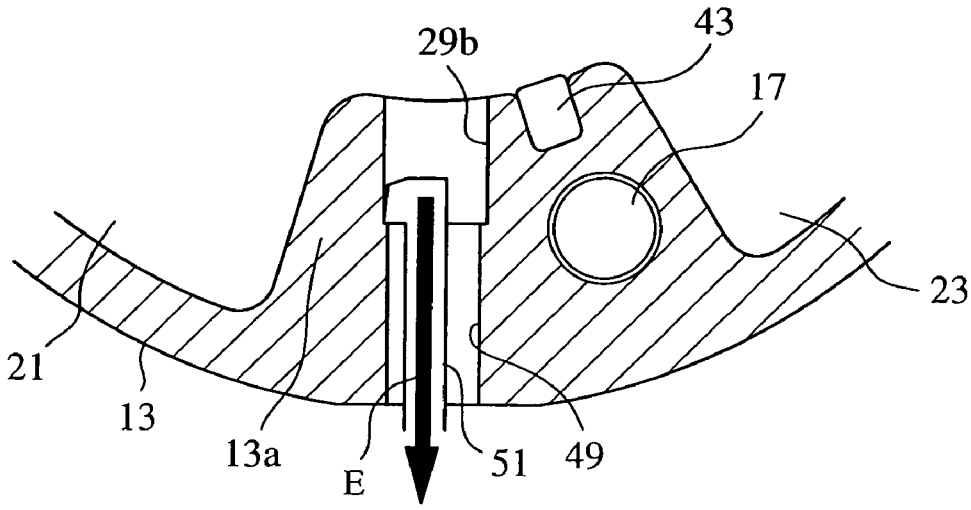
FIG. 7 is an enlarged radial sectional view showing the state where the interior of the receiving hole is finish-machined, which is to be carried out as the subsequent process shown in FIG. 6.
Figure 8:
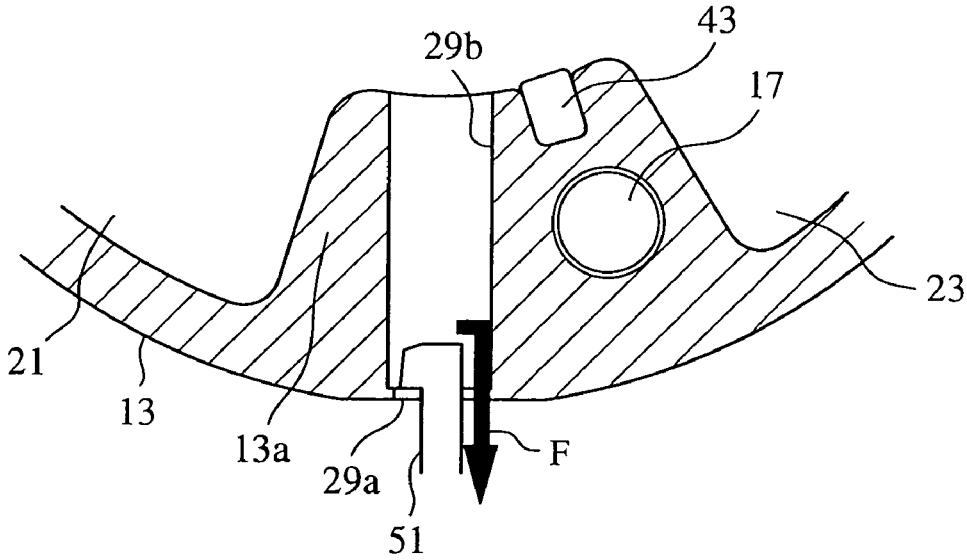
FIG. 8 is an enlarged radial sectional view showing the state where the small portion of the receiving hole is formed, which is to be carried out as the subsequent process shown in FIG. 7.
Figure 9:
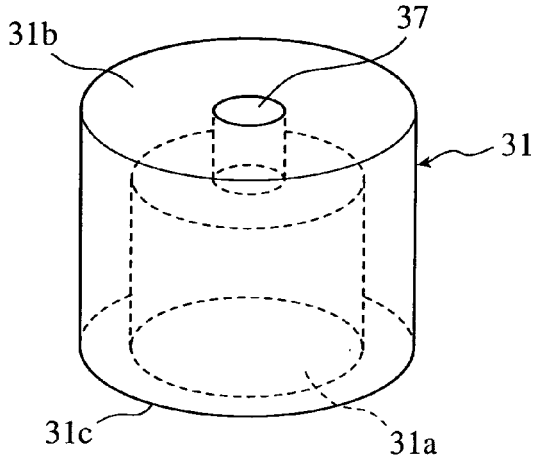
FIG. 9 is an enlarged perspective view showing the structure of the locking member of the valve timing adjusting device shown in FIG. 1.

FIG. 1 is a radial sectional view showing an internal structure of a valve timing adjusting device according to the first embodiment of the present invention. FIG. 2 is an axial sectional view taken along the line II—II of FIG. 1. FIG. 3 is an enlarged radial sectional view showing the state where an locking member, an urging member, and a lock pin are inserted in this order in a receiving hole in one process of assembly of the lock mechanism of the valve timing adjusting device shown in FIG. 1. FIG. 4 is an enlarged radial sectional view showing the state where the locking member, the urging member, and the lock pin are inserted in the receiving hole in the subsequent process shown in FIG. 3. FIG. 5 is an enlarged radial sectional view showing the state where the lock pin is held at the backward end by the negative-pressure generating means of an assembly apparatus in the subsequent process shown in FIG. 4. FIG. 6 is an enlarged radial sectional view showing the state where a through hole is formed in the forming process of the receiving hole of the valve timing adjusting device shown in FIG. 1. FIG. 7 is an enlarged radial sectional view showing the state where the interior of the receiving hole is finish-machined, which is carried out as the subsequent process shown in FIG. 6. FIG. 8 is an enlarged radial sectional view showing the state where the small portion of the receiving hole is formed, which is carried out as the subsequent process shown in FIG. 7. FIG. 9 is an enlarged perspective view showing the structure of the locking member of the valve timing adjusting device shown in FIG. 1. It should be understood that the expression "axially" as used herein means "axially to the valve timing adjusting device (axially to the device)," and the expression "radially" means "radially to the same device (radially to the device)."

As shown in FIG. 1 and FIG. 2, a valve timing adjusting device 1 according to the first embodiment is generally composed of a first rotor 3 that rotates synchronously with a crankshaft (not shown) of an engine (not shown) in the direction indicated by the arrow A through a chain (not shown); a second rotor 7 that is provided within the first rotor 3, and is integrally secured on the end face of an intake or an exhaust camshaft 5 (hereinafter referred to simply as a camshaft); and a lock mechanism 9 that restricts a relative rotation between the first rotor 3 and the second rotor 7.

The first rotor 3 is generally composed of a housing 11 that has outside a sprocket 11*a* receiving a rotational driving force of the crankshaft (not shown), and has inside a bearing (not shown) slidingly contacting with the outer peripheral surface located in the vicinity of the end face of the camshaft 5; a case 13 that is arranged adjacently to the housing 11, and has a plurality of shoes 13*a* (four shoes in the first embodiment as shown in FIG. 1) that inwardly project radially to form a plurality of spaces; and a cover 15 that covers the internal space of the case 13. And these components are integrally fastened to each other with a bolt 17.

The second rotor 7 is a rotor having a boss 7*a* integrally fastened on the end face of the camshaft 5 with a bolt 19 and a plurality of vanes 7*b* outwardly projecting radially from the periphery of the boss 7*a* (the second rotor 7 is also referred to as a vane rotor 7 hereinafter). Each of the vanes 7*b* of the vane rotor 7 partitions each of a plurality of internal spaces formed by the shoes 13*a* of the case 13 into an advanced side oil pressure chamber 21 supplied with hydraulic pressure when the vane rotor 7 is relatively rotated in the direction of the advanced side with respect to the first rotor 3 and an lagged side oil pressure chamber 23 supplied with hydraulic pressure when the vane rotor 7 is relatively rotated in the direction of the lagged side with respect to the first rotor 3. One end of a first oil passage 25 formed within the camshaft 5 is connected with each of the advanced side oil pressure chambers 21, and one end of a second oil passage 27 similarly formed within the camshaft 5 is connected with each of the lagged side oil pressure chambers 23. Each of the other ends of the first oil passage 25 and the second oil passage 27 extends to an oil pump (not shown) and an oil pan (not shown) through an oil controlling valve (not shown, and hereinafter referred to as an OCV.).

In one shoe 13*a* of the case 13 provided in the valve timing adjusting device 1, a receiving hole 29 passing through radially to the shoe is formed. As shown in FIG. 3, the receiving hole 29 has a stepped structure composed of a small part 29*a* provided at the outermost located radially to the device and a large part 29*b* provided at the position radially to the device more internally than the position of the small part 29*a*. In the large part 29*b* of the receiving hole 29, an locking member 31, a coil spring (urging member) 33, and a lock pin 35 are inserted in this order from the innermost part of the hole formed radially to the device, and the locking member 31 located at the outermost radially to the device is prevented from coming off from the receiving hole 29 by the small part 29*a* even when stress is outwardly applied to the member located radially to the device. The lock pin 35 is a nearly cylindrical member that is reciprocally slidable axially within the large part 29*b* of the receiving hole 29, and a bottomed hole 35*a* is formed in the bottom of the pin located outside radially to the member.

The locking member 31 is a bottomed cylindrical member having inside radially a bottomed hole 31*a*, and in the bottom of the bottomed hole 31*a*, is formed a back-pressure exhausting hole 37 that causes the space within the receiving hole 29 to communicate with the atmosphere, which passes through the hole axially relative thereto, and is located behind the lock pin 35. Moreover, a top edge 31*c* located inside radially to the device of the locking member 31 defines the backward end of the lock pin 35. The locking member 31 has a so simple shape that a mold can be divided into upper and lower parts, as shown in FIG. 9, which enables the member to be manufactured by highly dimensionally accurate and low price forging or injection molding of synthetic resin.

The coil spring 33 is provided between the bottomed hole 31*a* of the locking member 31 and the bottomed hole 35*a* of the lock pin 35, and for continuously inwardly urging the lock pin 35 radially. This coil spring 33 is arranged to have a set load such that the lock pin is not accidentally released by centrifugal force when the lock pin engaged the engaging hole. For this reason, as shown in FIG. 4, when the spring has free length, the lock pin 35 projects inwardly from the large part 29*b* of the receiving hole 29 radially to the device.

Meanwhile, in the periphery of the boss 7*a* of the vane rotor 7, which opposes the shoe 13*a* having the receiving hole 29, is formed an engaging hole 39 in which the lock pin 35 engages after the lock pin 35 is inwardly advanced radially by an urging force of the coil spring 33 when a relative position of the vane rotor 7 with respect to the case 13 taken the most lagged position (lock at the most lagged position). Between the engaging hole 39 and the second oil passage 27, is provided a lock-releasing oil passage 41 that feeds hydraulic pressure (lock-releasing hydraulic pressure) for outwardly forcing radially the lock pin 35 back against an urging force of the coil spring 33 to the top end face 35*b* of the lock pin 35.

The above-described receiving hole 29, locking member 31, coil spring 33, lock pin 35, back-pressure exhausting hole 37, engaging hole 39, and lock-releasing oil passage 41 constitute the lock mechanism 9.

In the outermost periphery of each of the vanes 7*b* of the vane rotor 7 and in the innermost periphery of each of the shoes 13*a* of the case 13, seal means 43 for preventing a flow of oil between the advanced side oil pressure chamber 21 and the lagged side oil pressure chamber 23 are provided. As shown in FIG. 2, a seal means 43 is generally composed of a seal 43*a* that slidingly contacts with the outer periphery of the boss 7*a* of the vane rotor 7 or the inner periphery of each of the shoes 13*a* of the case 13, which constitute the advanced side oil pressure chambers 21 or the lagged side oil pressure chambers 23, and a leaf spring 43*b* that urges the seal 43*a* toward the outer periphery or the inner periphery.

The operation will now be described as below.

First of all, when the engine is stopped or immediately after the engine is started, oil remaining in the advanced side oil pressure chamber 21 and the lagged side oil pressure chamber 23 of the valve timing adjusting device 1 is returned to an oil pan (not shown) via the first oil passage 25, second oil passage 27, and OCV (not shown), thereby dropping the hydraulic pressure in the advanced side oil pressure chamber 21 and the lagged side oil pressure chamber 23. Consequently, the lock pin 35 engages the engaging hole 39 by an urging force of the coil spring 33, and a relative rotation between the first rotor 3 and the second rotor 7 is restricted to the most lagged position (locking state).

After that, when the oil pump (not shown) is driven by starting the engine, oil is supplied from the oil pan (not shown) to the lagged side oil pressure chamber 23 of the valve timing adjusting device 1 via the OCV (not shown) and the second oil passage 27. Subsequently, in cases where the valve timing adjusting device is rotated to a predetermined advanced position depending on how the engine operates, when the lagged side oil pressure acted on the tip of the lock pin 35 from the first oil passage 25 via the lock-releasing oil passage 41, the lock pin 35 thrusts back and retreats against an urging force of the coil spring 33 to thereby come out of the engaging hole 39. At that time, when the lock pin 35 began to outwardly retreat radially to the device, the back pressure presenting behind the lock pin 35 is exhausted outside from the back-pressure exhausting hole 37 provided in the locking member 31. For this reason, the retreating movement of the lock pin 35 is not influenced by the back pressure. Thus, receiving the advanced side oil pressure in this manner comes out of the engaging hole 39, and at the same time the second rotor 7 relatively rotates to the advanced side with respect to the first rotor 3.

The first rotor 3 and second rotor 7 in the lock-releasing state are permitted to relatively move to the advanced side or lagged side by a predetermined rotation angle by the advanced side oil pressure supplied to the advanced side oil pressure chamber 21 and the lagged side oil pressure supplied to the lagged side oil pressure chamber 23 at that time.

In the lock-releasing state, as shown in FIG. 1, when trying to move the relative position of the second rotor 7 to the advanced side or the most advanced position with respect to the first rotor 3, the second rotor 7 is relatively rotated in the direction of the arrow A by advanced side oil pressure.

Similarly, in the lock-releasing state, as shown in FIG. 1, when undertaking to move the relative position of the second rotor 7 to the lagged side or the most lagged position with respect to the first rotor 3, the second rotor 7 relatively rotates in the reverse direction of the arrow A by lagged side oil pressure.

The method of assembling components in the receiving hole 29 of the lock mechanism 9 will now be described as below.

Before assembling the vane rotor 7 in the case 13 as shown in FIG. 3, the locking member 31 is, first of all, inserted in the large part 29*b* of the receiving hole 29 formed in one of the shoes 13*a*. At that time, the coil spring 33 is kept in the state in which one end of the coil spring is inserted in the bottomed hole 31*a* of the locking member 31. Subsequently, while keeping the other end of the coil spring 33 inserted in the bottomed hole 35*a* of the lock pin 35, the lock pin 35 is inserted in the large part 29*b* of the receiving hole 29, following on the coil spring 33, as shown to FIG. 4. In this state, the coil spring 33 has free length, and as mentioned above, the top end face 35*b* of the lock pin 35 projects from the large part 29*b* of the receiving hole 29 inwardly radially of the device. Moreover, the bottom end face 31*b* of the locking member 31 abuts the small part 29*a* of the receiving hole 29, and the small part 29*a* prevents the locking member from outwardly coming off radially to the device.

After that, in the state shown in FIG. 4, when the tip of a nozzle (negative-pressure generating means) 45 that is equipped with an aspiration passage 45*a* connected with the main body of a decompressor (not shown, negative-pressure generating means) is contacted with the bottom of the locking member 31, which is locked by the small part 29*a* of the receiving hole 29, and then the main body of the decompressor (not shown) is driven, the air, presenting in the space formed behind the lock pin 35 and also in the space formed between the locking member 31 and the lock pin 35, begins to be exhausted in the direction of the arrow C through the back-pressure exhausting hole 37 of the locking member 31, as shown in FIG. 5. Thereby, both the spaces come into the state of negative pressure, and the lock pin 35 begins to retreat by the negative pressure against an urging force of the coil spring 33, and the bottom edge 35*c* of the lock pin 35 ultimately comes in contact with the top edge 31*c* of the locking member 31. At that time, the lock pin 35 stops at the backward end, and the top end face 35*b* of the lock pin 35 is completely received within the receiving hole 29, and therefore does not project from the inner periphery of the shoe 13*a*. In this state, the vane rotor 7 is inserted in the case 13, as shown in FIG. 1.

The method of forming the receiving hole 29 will now be explained as below.

For the reason that it is difficult to form the receiving hole 29 by plastic working irrespective of whether the case 13 is made by metal or light metal, it is necessary to form the hole by machining. Further, the inner peripheral surface of the receiving hole 29 has faculty of causing the lock pin 35 to smoothly slide, as well as of completely sealing the lock-releasing hydraulic pressure applied to the top end face 35*b* of the lock pin 35 between the inner peripheral surface thereof and the outer peripheral surface of the lock pin 35. Accordingly, dimensional accuracy and surface smoothness are strictly required for the inner peripheral surface of the receiving hole 29.

When the receiving hole 29 is formed by machining, first of all, as shown in FIG. 6, the shoe 13*a* is drilled in the direction of the arrow D from the outward of the case 13 to the inside thereof by means of a drill 47 having an outer diameter smaller than the inner diameter of the receiving hole 29 to be formed, thereby forming a through hole 49 (drilling process). Subsequently, as shown in FIG. 7, a boring tool 51 is inserted in the through hole 49 from the outside of the case 13, and the inner peripheral surface of the through hole 49 is cut from the outward of the case 13 in the direction of the arrow E, thereby finish-cutting the surface thereof such that the diameter of the through hole is equal to the inner diameter of the large part 29*b* of the receiving hole 29, and forming the large part 29*b* (finish machining). After that, as shown in FIG. 8, when the boring tool 51 approached the outermost of the through hole 49 radially to the device, the finish machining by means of the boring tool 51 is stopped. Then, the boring tool 51 is moved in the direction of the arrow F to take out it from the through hole 49. By applying such finish machining to the through hole 49, the outermost part left without applying the finish machining thereto by the boring tool 51 serves as the small part 29*a* of the receiving hole 29.

As mentioned above, through the structure according to the first embodiment in which the valve timing adjusting device is arranged to include the first rotor 3 that rotates synchronously with the crankshaft (not shown) of the engine (not shown), the second rotor 7 that is relatively rotatable by a predetermined angle within the first rotor 3, and is integrally secured on the end face of the camshaft 5 of the engine (not shown), and the lock mechanism 9 that restricts a relative rotation between the first rotor 3 and the second rotor 7, wherein the receiving hole 29 of the lock mechanism 9 is provided with the small part 29*a* at the outermost of the hole formed radially to the device, the claimed invention prevents the locking member 31 from outwardly falling out radially to the device by the small part 29*a* of the receiving hole 29, thereby greatly enhancing reliability of the lock mechanism 9.

Through the structure according to the first embodiment in which the locking member 31, the coil spring 33, and the lock pin 35 are assembled in the receiving hole 29 in this order from the innermost part of the hole formed radially to the device, the claimed invention allows an insertion of the locking member 31, the coil spring 33, and the lock pin 35 in the receiving hole 29 in this order from the innermost part of the hole formed radially to the device, thereby facilitating assembly of the components.

Through the structure according to the first embodiment in which the locking member is adopted which has an external diameter substantially the same as that of the lock pin, and is formed by forging, the claimed invention achieves increased reliability and reduced cost of the lock mechanism and the valve timing adjusting device by the aid of the highly dimensionally accurate and inexpensive locking member.

Through the structure according to the first embodiment in which the valve timing adjusting device is arranged such that the locking member is adopted which has an external diameter substantially the same as that of the lock pin, and is formed of synthetic resin, the claimed invention accomplishes increased reliability, reduced cost, and light weighted lock mechanism 9 and the valve timing adjusting device 1 by the aid of the highly dimensionally accurate and inexpensive locking member.

Through the structure according to the first embodiment in which the valve timing adjusting device is arranged such that the small part 29*a* of the receiving hole 29 prevents the locking member 31 from falling out, the claimed invention securely prevents the locking member from falling out without expanding the dimension radially to the device, and without using an additional component for the prevention of fallout, even when the device does without a timing pulley in contrast to the structure of the conventional locking member.

Through the structure according to the first embodiment, the valve timing adjusting device is arranged to include a nozzle 45 that is provided at the outside of the receiving hole 29 formed radially to the device, and that gives negative pressure for holding the lock pin 35 at the backward end through the back-pressure exhausting hole 37 of the locking member 31, the claimed invention facilitates assembly of the vane rotor 7 in the case 13 thanks to the lock pin 35 that can be completely received within the receiving hole 29 by the nozzle 45 so as to avoid the inward projection of the lock pin 35 radially to the device. In addition, in contrast to the conventional assembly of the locking member, the claimed invention obviates the necessity of adding a process of compressing the urging member such as the coil spring by means of a jig when assembling the locking member, and a process of pulling out the jig after the assembly of the stopper therein is completed.

It will be appreciated that while in the first embodiment the valve timing adjusting device is arranged such that the relative rotating position (initial position) between the case 13 and the vane rotor 7 is set to the most lagged position, the device may be arranged such that the initial position is set to the most advanced position or to the intermediate position located between the most advanced position and the most lagged position.

Second Embodiment

Figure 10:
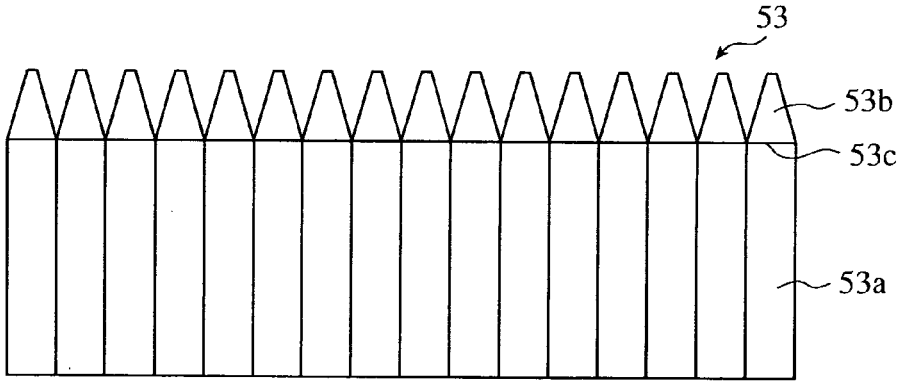
FIG. 10 is a plan view showing the developed plate material, which is to be used in manufacture by sheet metal, of the locking member of a valve timing adjusting device according to a second embodiment of the present invention.
Figure 11:
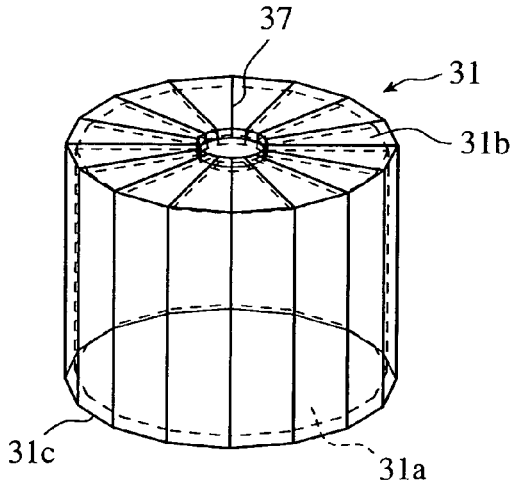
FIG. 11 is a perspective view showing a structure of the locking member manufactured by bending a plate material shown in FIG. 10.

FIG. 10 is a plan view showing a developed plate material, used in manufacture by sheet metal, of the locking member of a valve timing adjusting device according to the second embodiment of the present invention. FIG. 11 is a perspective view showing the structure of the locking member manufactured by bending the plate material shown in FIG. 10. Of the constituent elements used in the second embodiment, like constituent elements commonly appeared in the first embodiment are designated by like reference numerals. Thus, the explanations of the elements are omitted for brevity's sake.

A feature of Embodiment 2 is that the locking member 31 having an external diameter substantially the same as that of the lock pin 35 is manufactured by sheet metal. When trying to manufacture the locking member 31, first of all, as shown in FIG. 10, a metallic plate material 53 has to be prepared. This plate material 53 is nearly rectangular in shape, and is generally composed of a plurality of strips 53*a* formed by indenting the material along one side thereof, a plurality of triangular parts 53*b* integrally connected to one short side of each of the strips 53*a*, and a plurality of borderlines 53*c* partition each of strips constituting the plate material into the strip 53*a* and the triangular part 53*b*. Each between the strips 53*a* constituting the plate material 53 having such a structure, bendable weakened lines are formed, and the borderlines 53*c* are also formed of bendable weakened lines. After that, the plate material 53 is bent at all the places of the weakened lines between the strips 53*a* to thereby form a cylindrical body, and the formed junctures are secured to each other as needed. Then, the base of each of the triangular parts 53 is bent at the place of its borderline 53*c*, thereby forming one end face (bottom end face 31*b*) of the cylindrical body, which obtains an locking member 31 that has a bottomed hole 31*a* and a top edge 31*c*. At that time, the height of the top of each of the triangular parts 53*b* is designed shorter than the radius of the one end face of the cylinder body to form a round hole (back-pressure exhausting hole 37) at the central of the end face.

As mentioned above, through the structure according to the second embodiment in which the valve timing adjusting device is arranged such that the locking member 31 having an external diameter substantially the same as that of the lock pin 35 is manufactured by sheet metal, the claimed invention achieves increased reliability and reduced cost of the lock mechanism 9 and the valve timing adjusting device 1 by the aid of the highly dimensionally accurate and inexpensive locking means.

What is claimed is:

1. A valve timing adjusting device comprising:

a first rotor that rotates synchronously with a crankshaft of an internal combustion engine;

a second rotor that is relatively rotatable by a predetermined angle within the first rotor, and is integrally secured on the end face of an intake camshaft or an exhaust camshaft of the internal combustion engine; and a lock mechanism having a receiving hole that is formed passing through the first rotor radially to the device; a lock pin that is slidably provided within the receiving hole; an engaging hole that is formed within the second rotor, and engages with the lock pin; an urging member for urging the lock pin toward the second rotor; and a locking member for locking the urging member within the receiving hole;

wherein the receiving hole of the lock mechanism is a stepped structure having a small part at the outermost located radially to the device.

2. The valve timing adjusting device according to claim 1, wherein the locking member, the urging member, and the lock pin are assembled in the receiving hole in this order from the innermost part of the hole formed radially to the device.

3. The valve timing adjusting device according to claim 2, wherein the locking member has an external diameter that is substantially the same as that of the lock pin, and manufactured by forging.

4. The valve timing adjusting device according to claim 2, wherein the locking member has an external diameter that is substantially the same as that of the lock pin, and manufactured by sheet metal.

5. The valve timing adjusting device according to claim 2, wherein the locking member has an external diameter that is substantially the same as that of the lock pin, and manufactured by synthetic resin.

6. An assembly apparatus of a valve timing adjusting device comprising:

a first rotor that rotates synchronously with a crankshaft of an internal combustion engine;

a second rotor that is relatively rotatable by a predetermined angle within the first rotor, and is integrally secured on the end face of an intake camshaft or an exhaust camshaft of the internal combustion engine; and a lock mechanism having a receiving hole that is formed passing through the first rotor radially to the device, and has a stepped structure having a small part at the outermost located radially to the device; a lock pin that is slidably provided within the receiving hole;

an engaging hole that is formed within the second rotor and engages with the lock pin; an urging member for urging the lock pin toward the second rotor; a locking member for locking the urging member within the receiving hole; and a back-pressure exhausting hole that is formed within the locking member, and exhausts back pressure of the lock pin into the open air;

wherein a negative-pressure generating means provided at the outside of the receiving hole formed radially to the device for giving negative pressure for holding the lock pin at the backward end of the pin through the back-pressure exhausting hole of the locking member.

* * * * *